United States Patent [19]

Nakajima et al.

[11] Patent Number: 4,796,587

[45] Date of Patent: Jan. 10, 1989

[54] AIR/FUEL RATIO CONTROL SYSTEM FOR INTERNAL COMBUSTION ENGINE

[75] Inventors: Toyohei Nakajima; Yasushi Okada, both of Wako, Japan

[73] Assignee: Honda Giken Kogyo Kabushiki Kaisha, Tokyo, Japan

[21] Appl. No.: 10,553

[22] Filed: Feb. 3, 1987

[30] Foreign Application Priority Data

Feb. 4, 1986 [JP] Japan ..... 61-14758[U]

[51] Int. Cl.[4] ..... F02D 41/14

[52] U.S. Cl. ..... 123/440; 73/23; 204/406

[58] Field of Search ..... 123/440, 489, 589; 60/276; 73/23; 204/406

[56] References Cited

U.S. PATENT DOCUMENTS 4,167,925 9/1979 Hosaka et al. ..... 123/489
4,306,444 12/1981 Hattori et al. ..... 73/23
4,324,218 4/1982 Hattori et al. ..... 123/489
4,391,256 7/1983 Sawada et al. ..... 123/489
4,665,874 5/1987 Kawanabe et al. ..... 123/440

*Primary Examiner*—Andrew M. Dolinar
*Attorney, Agent, or Firm*—Pollock, Vande Sande and Priddy

[57] ABSTRACT

An air/fuel ratio control system for an internal combustion engine includes an oxygen concentration sensor for producing an output signal to indicate the concentration of oxygen in the engine exhaust gases, and a circuit for producing a discrimination signal which expresses the inherent error, due to manufacturing deviations, in the output signal of the oxygen concentration sensor. Compensation of the output signal from the oxygen concentration sensor is performed in accordance with the discrimination signal, to produce a compensated output signal which controls means for adjusting the air/fuel ratio of the mixture supplied to the engine. Accurate control of the air/fuel ratio is thereby achieved, irrespective of differences in the operating characteristics of oxygen concentration sensors due to manufacturing deviations.

5 Claims, 3 Drawing Sheets

AIR/FUEL RATIO CONTROL SYSTEM FOR INTERNAL COMBUSTION ENGINE

BACKGROUND OF THE INVENTION

1. Field of the Invention

The present invention relates to an air/fuel ratio control system for an internal combustion engine.

2. Description of Background Information

An air/fuel ratio control system is utilized to purify the exhaust gases from an internal combustion engine, and to provide improved fuel economy. Such a control system generally detects the concentration of oxygen in the exhaust gases by means of an oxygen concentration sensor, and executes feedback control of the air/fuel ratio of the mixture supplied to the engine based upon an output signal from the sensor, to maintain the air/fuel ratio at a target value.

An oxygen concentration sensor for such an air/fuel ratio control system is known (Japanese patent No. 58-153155) whereby an output is produced which is proportional to the oxygen concentration in a gas under measurement. This oxygen concentration sensor includes an oxygen concentration sensor element having a pair of oxygen ion-conductive solid electrolytic members, each in the form of a flat plate. These solid electrolytic members have electrodes formed on respective surfaces thereof, and are disposed mutually parallel with a gap portion between them, within the gas under measurement. One of the solid electrolytic members functions as an oxygen pump element, and the other functions as a sensor cell element for sensing the oxygen concentration ratio. A current is caused to flow between the electrodes of the oxygen pump element, within the gas under measurement, such that the electrode of that element facing the gap between the two members operates as a negative electrode. The oxygen in the gas within the gap is ionized by this negative electrode of the oxygen pump element, and the resultant oxygen ions migrate through the interior of the oxygen pump element to the positive electrode of that element, and are then released as gaseous oxygen. When this takes place, the concentration of oxygen in the gap becomes reduced, so that a difference arises between the oxygen concentration in the gap and that of the gas at the exterior of the sensor cell element, whereby a voltage is developed between the electrodes of the sensor cell element. By varying the level of current supplied to the oxygen pump element such as to maintain this voltage at a constant value, the current level will vary in substantially linear proportion to the oxygen concentration in the gas under measurement, assuming a constant operating temperature. This current level constitutes an oxygen concentration sensing value output.

However with such an oxygen concentration sensor whereby an output is produced in proportion to the oxygen concentration, manufacturing deviations will readily arise during manufacture of the oxygen concentration sensor element formed of the oxygen pump element and sensor cell element, per manufacturing lots. Measures taken to reduce these manufacturing deviations will result in unavoidable increases in production costs. If this is not done, then manufacturing deviations of the oxygen concentration sensors will result in the the output levels from the sensors inherently being respectively different, for an identical air/fuel ratio. Thus, it will not be possible to accurately judge the air/fuel ratio of the mixture supplied to an engine based upon the output level from such an oxygen concentration sensor.

SUMMARY OF THE INVENTION

It is an objective of the present invention to provide an air/fuel ratio control system whereby the air/fuel ratio of the mixture supplied to an engine can be accurately judged on the basis of an output level from an oxygen concentration sensor, irrespective of manufacturing deviations of the oxygen concentration sensor.

In order to attain the above objective, an air/fuel ratio control system according to the present invention comprises signal generating means for producing a discrimination signal which expresses the inherent error in the output signal of an oxygen concentration sensor, and compensation means for compensating the output signal level from the oxygen concentration sensor in accordance with the discrimination signal and producing a compensated output signal level, with the air/fuel ratio of the mixture supplied to an engine being adjusted in accordance with the output level from the compensation means.

DETAILED DESCRIPTION OF EMBODIMENTS

Figure 1:
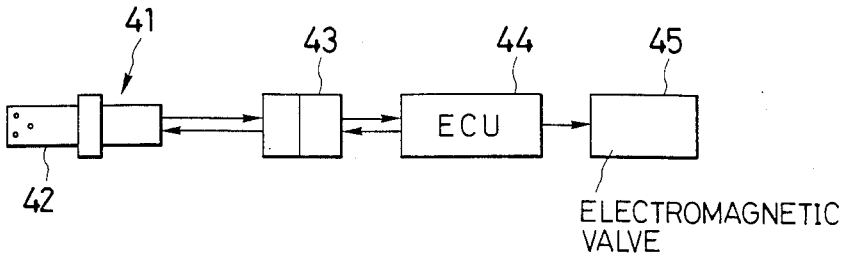
FIG. 1 is a general block diagram of an embodiment of the present invention.
Figure 2:
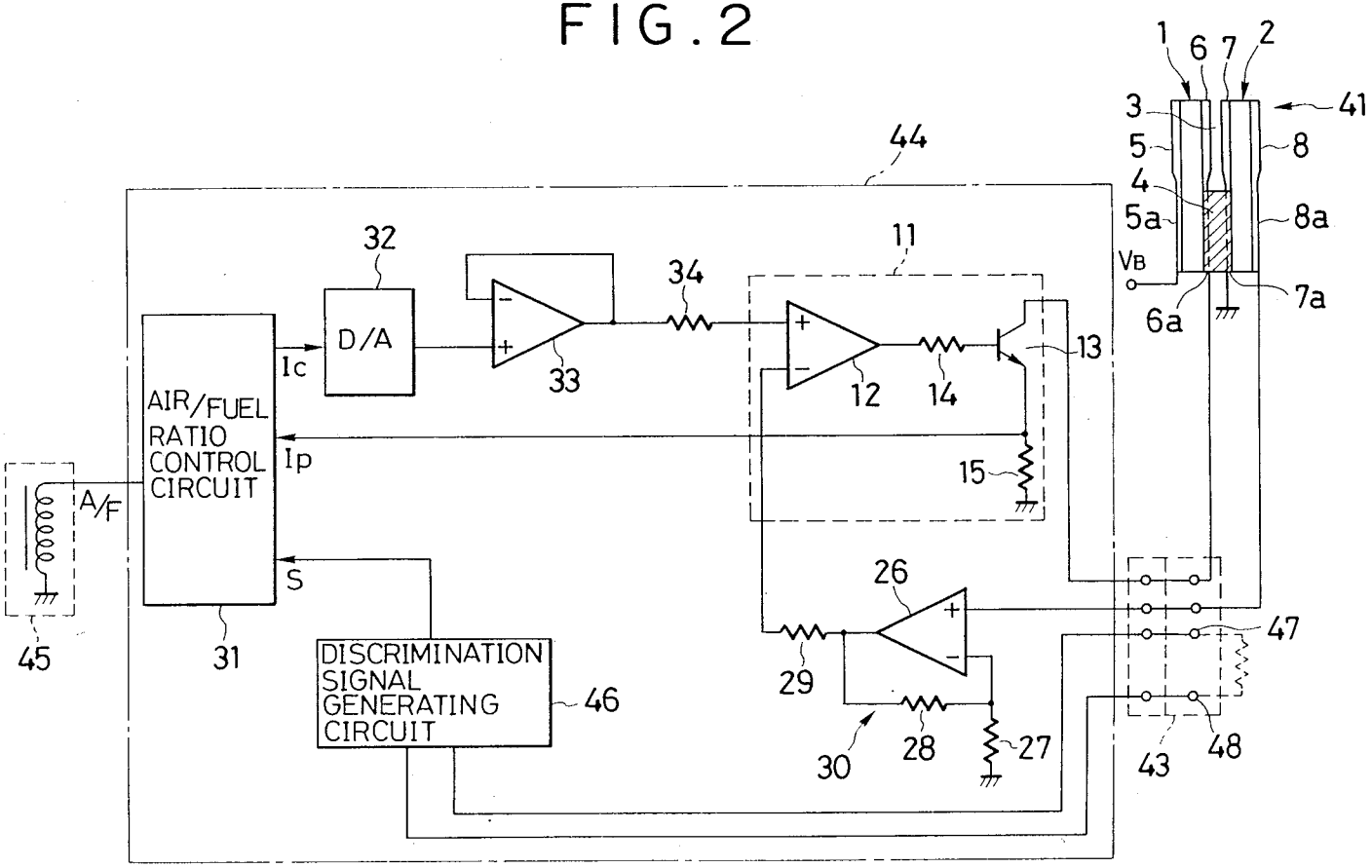
FIG. 2 is a circuit diagram of a specific example of the embodiment of FIG. 1.

FIGS. 1 and 2 show an embodiment of an air/fuel ratio control system according to the present invention. An oxygen concentration sensor unit 41 is mounted in the exhaust pipe of an internal combustion engine (not shown in the drawings). Within a protective case 42 of the oxygen concentration sensor unit 41 are mounted a pair of mutually parallel flat plate elements, constituting an oxygen pump element 1 and a sensor cell element 2. The body of each of oxygen pump element 1 and sensor cell element 2 consists of an oxygen ion-conductive solid electrolytic member, with a gap portion 3 being formed between the two elements at one end. Elements 1 and 2 are mutually attached at their opposite ends, by spacer 4. In addition, square-shaped electrode layers 5 through 8 are formed on oxygen pump element 1 and sensor cell element 2 on the front and rear faces of each element at one end, these layers being formed of a porous metallic material. Connecting leads 5*a* through 8*a* for layers 5 through 8 respectively are formed on the opposite ends of the front and rear faces of elements 1 and 2, with connecting leads 5*a* through 8*a* being connected through a connector 43 to an ECU (Electronic Control Unit) 44.

A current is supplied to flow between electrodes 5 and 6 of oxygen pump element 1 by a current supply circuit 11, which is made up of an operational amplifier 12, an NPN transistor 13, and resistors 14 and 15. The output from operational amplifier 12 is supplied through resistor 14 to the base of transistor 13, while the emitter of transistor 13 is connected to ground potential through resistor 15. Resistor 15 serves to sense the value $I_p$ of the pump current which flows between electrodes 5 and 6 of the oxygen pump element 1, i.e. the voltage developed across resistor 15 is applied as the pump current level $I_p$ to the input terminals of the air/fuel ratio control circuit 31. The collector of transistor 13 is connected through connecting lead 6a to the inner electrode layer 6 of oxygen pump element 1, while a voltage $V_B$ is applied through connecting lead 5a to the outer electrode layer 5.

The inner electrode layer 7 of the sensor cell element 2 is coupled to ground potential through connecting lead 7a, while the outer electrode layer 8 is coupled to a non-inverting amplifier 30 through the connecting lead 8a. This non-inverting amplifier 30 is made up of operational amplifier 26 and resistors 27 to 29, and has the output terminal thereof connected to the inverting input terminal of operational amplifier 12. A D/A converter 32 is connected to the control output terminal $I_c$ of air/fuel ratio control circuit 31, and produces a voltage whose level is in accordance with a digital signal which is output from control terminal $I_c$. The output terminal of D/A converter 32 is coupled through a voltage follower circuit 33 (formed of an operational amplifier) and a resistor 34 to the non-inverting input terminal of operational amplifier 12.

Figure 3:
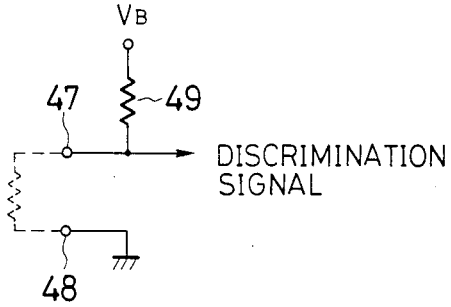
FIG. 3 is a circuit diagram of a specific example of a discrimination signal generating circuit used in the circuit of FIG. 2.

The air/fuel ratio control circuit 31 is preferably implemented as a microprocessor, and provided with an A/F drive terminal and an S input terminal in addition to the $I_p$ terminal. The A/F drive terminal is coupled to an electromagnetic valve 45, used for secondary air adjustment. The electromagnetic valve 45 is mounted in an intake secondary air supply passage, which leads into the air intake passage of the engine, downstream from the engine throttle valve. A discrimination signal generating circuit 46 is connected to the S input terminal. The discrimination signal generating circuit 46 serves to generate a discrimination signal which expresses the inherent error shown in the sensor output signal, determined by the oxygen concentration sensor element. As shown in FIG. 3, the discrimination signal generating circuit 46 is provided with connection terminals 47 and 48, with terminal 47 being connected to the S input terminal and also being connected through a resistor 49 to the $V_B$ potential. Terminal 48 is connected to ground potential. Terminals 47 and 48 are provided in connector 43, and can be connected together through either a resistor or a short-circuit. Although not shown in the drawings, the air/fuel ratio control circuit 31 includes an A/D converter which converts the analog signals applied to the $I_p$ input terminal and the S input terminal into digital signals.

The digital signal which is produced from output terminal $I_c$ of air/fuel ratio control circuit 31 is applied to the D/A converter 32, and is converted thereby into a voltage. This voltage is applied through the voltage follower circuit 33 and resistor 34 to appear as reference voltage $V_{r1}$ which is supplied to the non-inverting input terminal of operational amplifier 12. As a result, since the potential of the inverting input terminal of operational amplifier 12 is lower than the reference voltage $V_{r1}$, The output of operational amplifier 12 goes to the high level, thereby driving transistor 13 to the ON state. As a result of the ON condition of transistor 13, pump current $I_p$ flows between the electrodes 5 and 6 of oxygen pump element 1.

Due to this flow of pump current $I_p$, a voltage $V_s$ is developed between electrode layers 7 and 8 of the sensor cell element 2, and this voltage is amplified by non-inverting amplifier 30 and supplied to the inverting input terminal of operational amplifier 12. When voltage $V_s$ rises, then the output voltage $V_s'$ from non-inverting amplifier 30 also rises. If this output voltage $V_s'$ exceeds the reference voltage $V_{rl}$, then the output of operational amplifier 12 is inverted to fall to the low level, and transistor 13 is thereby set in the OFF state. As a result of this OFF state of transistor 13, the pump current $I_p$ is reduced, and hence the voltage $V_s$ generated between electrode layers 7 and 8 of sensor element 2 is reduced. The voltage $V_s'$ supplied to the inverting input terminal of operational amplifier 12 from the non-inverting amplifier 30 is thereby reduced. If voltage $V_s'$ falls back below the reference voltage $V_{r1}$, then the output from operational amplifier 12 will return to the high level, and the pump current $I_p$ will be amplified. The above operations are repetitively performed at high speed, so that the voltage $V_s$ is controlled to a constant level, with the value of $V_s$ being in accordance with the contents of the digital signal produced from the air/fuel ratio control circuit 31.

When the reference voltage $V_{r1}$ is supplied to operational amplifier 12, the pump current $I_p$ which flows between electrode layers 5 and 6 of the oxygen pump element 1 is sensed, as voltage $V_p$ appearing across the terminals of resistor 15, and is supplied to input terminal $I_p$ of control circuit 31.

Figure 4:
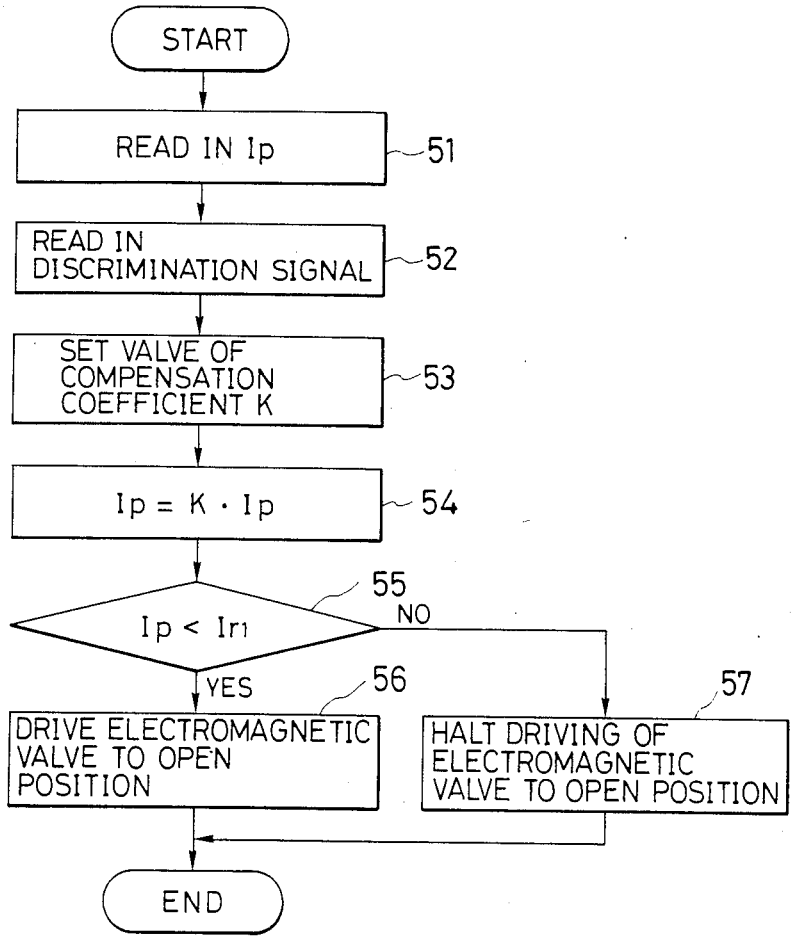
FIG. 4 is a flow chart for illustrating the operation of an air/fuel ratio control circuit.

The air/fuel ratio control circuit 31 operates in synchronism with the rotation of the engine, as follows. Firstly, as shown in FIG. 4, the pump current $I_p$ is read in, as terminal voltage $V_p$ (step 51). In addition, the discrimination signal is read in (step 52). The value of a compensation coefficient K is then established in accordance with the discrimination signal which has been read in (step 53). The air/fuel ratio control circuit 31 obtains a value for the compensation coefficient K corresponding to the read-in discrimination signal by looking up a data map, which has been stored in memory beforehand. The value of pump current $I_p$ which has been read in is then multiplied by the compensation coefficient K, and the result becomes a new value for the pump current $I_p$ (step 54). Next, the system judges whether or not the value of pump current $I_p$ thus obtained is smaller than a reference current level $I_{r1}$, which corresponds to a target air/fuel ratio (step 55). If $I_p < I_{r1}$, then this indicates that the mixture being supplied to the engine is excessively rich, and the air/fuel ratio control circuit 31 acts to drive electromagnetic valve 45 in the direction of valve opening, to supply secondary air to the engine (step 56). If on the other hand $I_p \geqq I_{r1}$, then this indicates that the mixture is lean, and so the driving of electromagnetic valve 45 in the direction of valve opening is halted, to halt the supply of secondary air to the engine (step 57).

Figure 5:
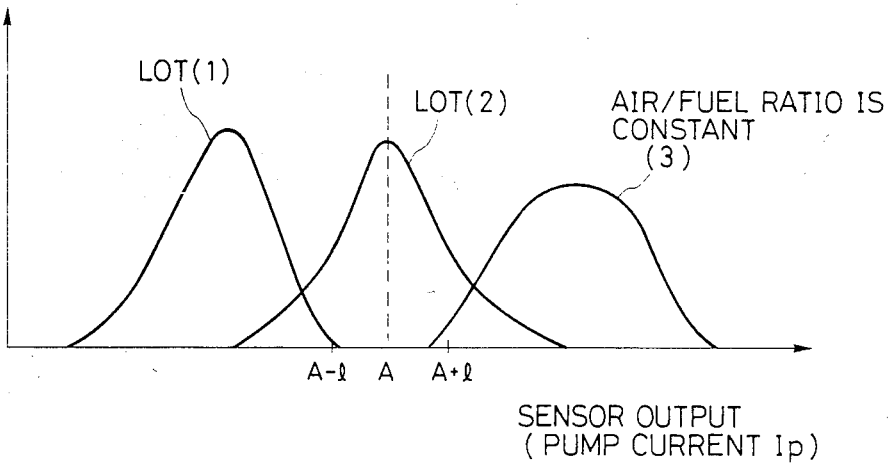
FIG. 5 is a diagram illustrating manufacturing deviations of sensor output signal levels, between different manufacturing lots.

The discrimination signal which is produced by discrimination signal generating circuit 46 is determined in the following manner. Firstly, a pump current is supplied to oxygen pump element 1 of the oxygen concentration sensor units of each manufacturing lot, with this pump current being such that the voltage $V_s$ will attain a predetermined value under a predetermined air/fuel ratio condition. The value of this pump current is measured. The distribution of respective pump current values for the various lots is thereby obtained, as shown in FIG. 5. If the difference between the center value of the distribution curve for a particular lot and the reference value A is within the permissible limits A±1, as in the case of lot (2) in FIG. 5, then the terminals 47 and 48 are left in the open-circuit condition. If on the other hand the difference between the center value of the distribution curve for a particular lot and the reference value A is outside the permissible limits A±1 as in the case of lots (1) and (3), then a value of resistance which is required between terminals 47 and 48 is determined in accordance with the amount of that difference, and a resistor having that value of resistance is connected between terminals 47 and 48. The value of the discrimination signal voltage is thereby determined by voltage division of $V_B$ in accordance with the resistance value thus connected, so that this discrimination signal supplied to the air/fuel ratio control circuit 31 expresses the sensor output characteristic.

In the embodiment of the invention described above, the discrimination signal generating circuit is formed of a voltage divider employing a fixed resistor. However it would be equally possible to configure this voltage divider by utilizing a variable resistor. Alternatively, it would be equally possible to employ a circuit which can generate arbitrarily determined digital signals.

Furthermore in the embodiment described above, an identical discrimination signal is established for all of the sensors in each manufacturing lot. However it would be equally possible to establish a suitable discrimination signal level for each individual oxygen concentration sensor.

With an air/fuel ratio control system according to the present invention, as described hereinabove, a discrimination signal is generated which expresses the inherent error in the output signal of an oxygen concentration sensor. Compensation of the output level from the oxygen concentration sensor is executed in accordance with this discrimination signal, whereby a desired output characteristic can be obtained, irrespective of manufacturing deviations of the oxygen concentration sensor itself. The air/fuel ratio of the mixture supplied to an engine can thus be accurately judged, thereby enabling more effective elimination of pollutants from the engine exhaust gases. In addition, the manufacturing yield of the oxygen concentration sensors can be increased, so that production costs are lowered.

Although the present invention has been described above with reference to specific embodiments, it should be noted that various changes and modifications to the embodiments may be envisaged, which fall within the scope claimed for the invention as set out in the appended claims.

What is claimed is:

1. An air/fuel ratio control system for an internal combustion engine, comprising:

an oxygen concentration sensor disposed within an exhaust gas passage of said internal combustion engine, said sensor having a linear output characteristic for producing an output signal varying in proportion to the concentration of oxygen in exhaust gases produced from said internal combustion engine;

an electric element having an electric characteristic which represents deviations of the actual value of said output signal from a predetermined reference linear output characteristic;

signal generating means for producing a discrimination signal in response to the electric characteristic of said electric element;

compensation means for performing compensation of said output signal of said oxygen concentration sensor in accordance with said discrimination signal, to produce a compensated output signal;

comparing means for comparing the compensated output signal with a reference signal corresponding to a target air/fuel ratio; and air/fuel ratio adjustment means for adjusting the air/fuel ratio of the mixture supplied to said internal combustion engine, in accordance with a resultant signal produced by said comparing means.

2. The air/fuel ratio control system of claim 1 wherein said electric characteristic of the electric element corresponds to a manufacturing lot to which said oxygen concentration sensor belongs.

3. The air/fuel ratio control system of claim 2 in which said electric characteristic of the electric element corresponds to the difference between a predetermined reference value and a center value of the distribution curve of output levels generated from oxygen concentration sensors at a preselected oxygen concentration, said sensors belonging to said manufacturing lot.

4. The air/fuel ratio control system of claim 1 wherein said electric element is a resistor element and said signal generating means comprises a voltage divider including at least two resistors one of which is said resistor element.

5. The air/fuel ratio control system of claim 4 wherein said system includes an electronic control unit comprising said signal generating means, said compensation means, said comparing means and said air/fuel ratio adjustment means, and said resistor element is disposed in a connector which connects said oxygen concentration sensor to said electronic control unit.

* * * * *